United States Patent [19]

Blaskowski et al.

[11] 4,332,207

[45] Jun. 1, 1982

[54] METHOD OF IMPROVING LOAD RESPONSE ON COAL-FIRED BOILERS

[75] Inventors: Henry J. Blaskowski, Avon; David Palchik, Bloomfield, both of Conn.

[73] Assignee: Combustion Engineering, Inc., Windsor, Conn.

[21] Appl. No.: 202,264

[22] Filed: Oct. 30, 1980

[51] Int. Cl.[3] ..... F23D 1/00

[52] U.S. Cl. ..... 110/347; 110/106; 110/186; 122/449

[58] Field of Search ..... 110/106, 347, 263, 232, 110/186, 262; 122/449

[56] References Cited

U.S. PATENT DOCUMENTS

| | | | |
|---|---|---|---|
| 1,481,067 | 1/1924 | Pomeroy | 110/106 |
| 1,562,411 | 11/1925 | Caracristi et al. | 110/106 |
| 2,141,604 | 12/1938 | Hardgrove | 110/106 |
| 2,328,498 | 8/1943 | Saathoff | 122/449 X |
| 3,150,962 | 9/1964 | Pearson | 110/106 X |
| 3,467,036 | 9/1969 | Garrett, Jr. | 110/106 |
| 4,173,189 | 11/1979 | Cooper | 110/106 |
| 4,263,856 | 4/1981 | Rickard | 110/347 X |

*Primary Examiner*—Edward G. Favors
*Attorney, Agent, or Firm*—William W. Habelt

[57] ABSTRACT

A method for rapidly changing the amount of pulverized coal supplied to a coal-fired furnace (10) equipped with a coal pulverizer (20) from a first steady-state level to a second steady-state level in response to a change in operating load demand. The amount of pulverized coal supplied to the furnace is instantaneously increased by providing pulverized coal to the furnace from a source (42) independent of the pulverizer or instantaneously decreased by diverting away from the furnace a portion of the pulverized coal being supplied by the pulverizer.

4 Claims, 1 Drawing Figure

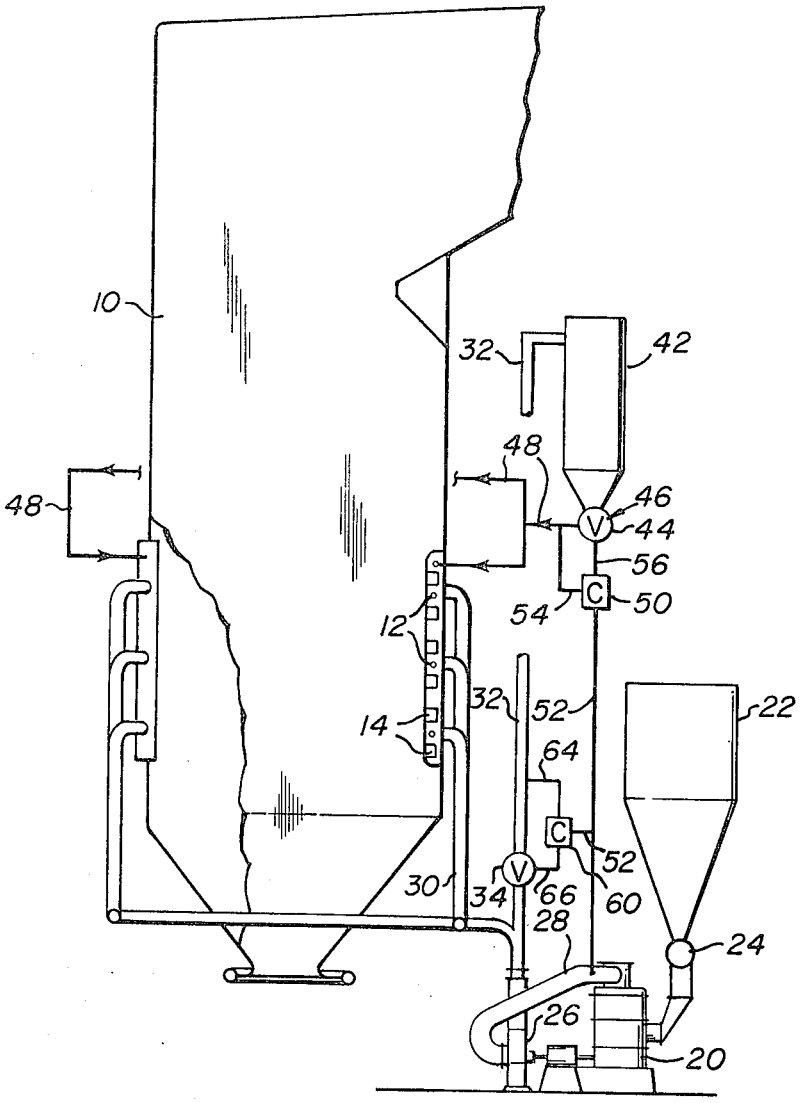
10
32
42
48
48
46
V
44
56
C
50
54
12
14
32
52
22
64
C
52
V
34
66
60
30
28
24
26
20

METHOD OF IMPROVING LOAD RESPONSE ON COAL-FIRED BOILERS

BACKGROUND OF THE INVENTION

The present invention relates to steam generating boilers and, more specifically, to a method of improving the response to changes in load demand of boilers equipped with coal pulverizers, particularly once-through sliding pressure boilers.

In the past, it was common for electrical utilities to use oil and natural gas-fired peaking boilers to meet rapid changes in load demands. However, in light of our dwindling resources of oil and natural gas, electric utilities are now turning to coal-fired boilers to meet both their base load and peak demand requirements. Consequently, coal-fired boilers are more frequently being required to operate in what is termed a cycling mode.

In a typical cycling mode, the coal-fired boiler will operate weekdays at full load during the day and at minimum load at night. On the weekends, the unit would be removed from service. Accordingly, it is desirable that coal-fired power plants be brought from minimum load, typically about 20 percent of peak load, to peak load as quick as possible in order to meet the sudden rise in load demand which typically occurs as businesses, industries, and homes start their day. Additionally, it is desirous that the coal-fired boilers be able to quickly reduce load in the evening.

One of the major factors limiting the ability of coal-fired boilers to respond quickly to changes in load demand lies in the inability to get coal through the pulverizers into the boiler quick enough. In the operation of a typical coal-fired boiler, coal is fed to the pulverizer where it is finally ground and dried by hot air. The coal is then transported in an air stream through fuel pipes, often over 500 feet in length, through the burners of the furnace.

In order to increase or decrease the amount of coal fired in the furnace and thereby increase or decrease the load generating capacity of the furnace, the amount of coal being fed to the pulverizer must be, accordingly, increased or decreased. To change the amount of coal being fired to the pulverizer, it is common to change the speed of the feeder which feeds raw coal from the storage bin through the pulverizer. If the feeder speed is increased, the amount of raw coal fed to the pulverizer also increases. Conversely, if the feeder speed is decreased, the amount of raw coal fed to the pulverizer decreases.

However, the immediate increase or decrease in the supply of raw coal to the pulverizer does not result in an immediate change in the output of pulverized coal from the pulverizer to the burners. Rather there is a significant delay which is a major factor limiting the ability of a coal-fired boiler to respond to rapid changes in load demand. The reason for the delay is the coal storage capacity of the pulverizer which results from the residence time that the coal spends in the pulverizer in the grinding process. A change in the supply of raw coal to the pulverizer will result in an immediate change in the storage of coal within the pulverizer with a gradual delayed change in the rate of supply of coal to the furnace. The rate of supply of coal to the furnace will gradually change until a new equilibrium point is reached where the rate of coal supplied to the furnace is equal to the rate of input of raw coal to the pulverizer.

Similarly, the reverse is true for a decrease of supply of raw coal to the pulverizer.

Because of this phenomenon, an operator is unable to rapidly change the rate of supply of coal to the furnace in order to generate the necessary heat to meet a rapid change in load demand. Rather, he must change the supply of raw coal to the pulverizer in a series of step changes with a pause between each step change to allow the rate of supply of pulverized coal to the furnace to match the rate of supply of raw coal to the pulverizer during that step. That is, he must delay his response to the rapid load change long enough to allow the pulverizer storage capacity to reach a new equilibrium point.

SUMMARY OF THE INVENTION

It is, accordingly, an object of the present invention to accomplish a change in the amount of pulverized coal supplied to a coal-fired furnace in response to a change in load demand on the furnace as a rapid step change in pulverized coal supply without experiencing the delay inherent in the ability of a coal pulverizer to respond to load changes as described hereinbefore.

In accordance with the present invention, the amount of pulverized coal supplied to a coal-fired furnace equipped with a coal pulverizer is increased from a first steady-state level to a second steady-state level by causing a step increase in the rate of input of raw coal to the pulverizer and simultaneously establishing an additional supply of pulverized coal to the furnace from a source independent of the pulverizer. The additional supply of pulverized coal is initially established at an amount sufficient to cause a step increase in the amount of pulverized coal supplied to the furnace from the first steady-state level to the second steady state level. As the pulverizer output gradually increases in response to the step increase in the rate of input of raw coal to the pulverizer, the response of the pulverizer being delayed due to the storage capacity of the pulverizer as described hereinbefore, the amount of pulverized coal supplied to the furnace from the independent supply source is controllably decreased so that the total amount of pulverized coal supplied to the furnace by means of the pulverizer and the independent supply source together remains constant at the desired second steady-state level. As soon as the pulverizer output stabilizes at the second steady-state level, the additional supply of pulverized coal to the furnace from the independent source is terminated.

Similarly, in accordance with the present invention, the amount of pulverized coal supplied to a coal-fired furnace equipped with a coal pulverizer is decreased from a first steady-state level to a second steady-state level by causing a step decrease in the rate of input of raw coal to the pulverizer and simultaneously diverting away from the furnace a portion of the pulverized coal being supplied by the pulverizer. The diverted portion of pulverized coal is initially established at an amount sufficient to cause a step decrease in the amount of pulverized coal supplied to the furnace from the first steady-state level to the second steady-state level.

As the pulverizer output gradually decreases in response to the step decrease in the rate of input of raw coal to the pulverizer, the response of the pulverizer being delayed to the storage capacity of the pulverizer as described hereinbefore, the amount of pulverized coal diverted away from the furnace is controllably decreased so that the total amount of pulverized coal supplied to the furnace from the pulverizer remains constant at the desired second steady-state level. As soon as the pulverizer output stabilizes at the second steady-state level, the diverting away from the furnace of a portion of the pulverized coal output of the pulverizer is terminated.

BRIEF DESCRIPTION OF THE DRAWINGS

The sole FIGURE of the drawing is a diagrammatic view of a coal-fired furnace employing a pulverized coal supply system capable of carrying out the method of the present invention.

DETAILED DESCRIPTION OF THE PREFERRED EMBODIMENT

Referring to the drawing, there is illustrated a coal-fired furnace 10 equipped with a pulverizer 20 for supplying pulverized coal to the furnace. The pulverized coal enters the furnace 10 entrained in a stream of transport air through one or more elevations of nozzles or burners 12 disposed in the wall of the furnace 10. Additional combustion air enters the furnace through a plurality of air nozzles 14 also disposed in the walls of the furnace around the burners 12. Combustion takes places in the interior of the furnace 10, producing hot flue gases that flow out of the furnace over various convection surfaces disposed therein to a stack.

In normal operation, raw coal is fed to the pulverizer 20 from the raw coal storage bin 22 through a variable speed feeder 24 disposed at the outlet of the raw coal bin. The raw coal is ground in the pulverizer 20 and dried by hot air drawn through the pulverizer 20 by the exhauster fan 26. The pulverized coal is entrained in the hot air to form a coal/air stream which is conveyed out of the pulverizer 20 through outlet duct 28 to the exhauster fan 26 and thence through the main fuel pipe 30 to the burners 12 for combustion in the furnace 10. Although a single pulverizer 20 is depicted in the FIGURE as supplying pulverized coal to the plurality of burners 12, a coal-fired furnace will generally be equipped with a plurality of pulverizers 20, each serving one elevation of burners 12.

The amount of pulverized coal output from the pulverizer 20 depends upon the amount of raw coal fed to the pulverizer 20 through the feeder 24. In order to change the amount of pulverized coal output from the pulverizer 20, the operator changes the speed, i.e., the feed rate of the feeder 24. However, as mentioned previously herein, the output of the coal pulverizer 20 does not change instantaneously with a change in the speed of the feeder 24. Rather, there is a significant delay due to the storage capacity of the pulverizer 20. Thus, there will be a time lag of as much as several minutes between the change of speed of the raw coal feeder 24 until the output of pulverized coal from the pulverizer 20 reaches a new steady-state level equivalent to the new feeder speed. Accordingly, the operator is unable to instantaneously change the amount of pulverized coal being fed to the furnace 10 in response to an increase in load demand on the furnace.

According to the present invention, the amount of pulverized coal supplied to the furnace may be instantaneously increased from a first steady-state level to a second steady-state level in response to an increase in operating load demand. In order to do so, the speed of the raw coal feeder 24 is increased so as to cause a step increase in the rate of input of raw coal from the storage bin 22 to the pulverizer 20 from a first rate corresponding to a pulverizer output commensurate with the first steady-state level of pulverized coal supply to a second rate corresponding to a pulverizer output commensurate with the second steady-state level of pulverized coal supply.

Simultaneously with the increase in rate of input of raw coal to the pulverizer 20, an additional supply of pulverized coal to the furnace is established from a source independent of the pulverizer 20, preferably from a pulverized coal storage bin 42. The additional supply of pulverized coal is initially established at an amount sufficient to cause a step increase in the amount of pulverized coal supplied to the furnace 10 from the first steady-state level of pulverized coal supply to the second steady-state level of pulverized coal supply. That is, the total supply of pulverized coal to the furnace is instantaneously increased from that level necessary to maintain load at the old load demand, i.e., the first steady-state level, to that level necessary to maintain load at the new load demand, i.e., the second steady-state level.

As the pulverizer output gradually increases in response to the step increase in rate of input of raw coal from the raw coal bin 22 to the pulverizer 20, the amount of pulverized coal supplied to the furnace 10 from the independent source 42 is controllably decreased so that the total amount of pulverized coal supplied to the furnace by means of the pulverizer 20 and the independent source 42 together remains constant at the second steady-state level thereby ensuring that sufficient pulverized coal is supplied to the furnace to maintain load at the new load demand despite the inability of the pulverizer to instantaneously meet the new load demand due to the delay in pulverizer output caused by pulverizer storage.

Simultaneously with the output of pulverized coal from the pulverizer 20 stabilizing at that level necessary to maintain the new load demand, the additional supply of pulverized coal to the furnace from the independent source is terminated.

Alternatively, the amount of pulverized coal supplied to the furnace may be instantaneously decreased from a first steady-state level to a second steady-state level in response to a decrease in operating load demand. In order to do so, the speed of the raw coal feeder 24 is decreased so as to cause a step decrease in the rate of input of raw coal from the storage bin 22 to the pulverizer 20 from a first rate corresponding to a pulverizer output commensurate with the first steady-state level of pulverized coal supply to a second rate corresponding to a pulverizer output commensurate with the second steady-state level of pulverized coal supply.

Simultaneously with the decrease in rate of input of raw coal to the pulverizer 20, a portion of the pulverized coal is diverted from the furnace, preferably to the pulverized coal storage bin 42. The diverted portion of pulverized coal is initially established at an amount sufficient to cause a step decrease in the amount of pulverized coal supplied to the furnace 10 from the first steady-state level of pulverized coal supply to the second steady-state level of pulverized coal supply. That is, the total supply of pulverized coal to the furnace is instantaneously decreased from that level necessary to maintain load at the old load demand, i.e., the first steady-state level, to that level necessary to maintain load at the new load demand, i.e., the second steady-state level.

As the pulverizer output gradually decreases in response to the step decrease in rate of input of raw coal from the raw coal bin 22 to the pulverizer 20, the amount of pulverized coal diverted away from the furnace 10 is controllably decreased so that the total amount of pulverized coal supplied to the furnace by means of the pulverizer 20 remains constant at the second steady-state level thereby ensuring that sufficient pulverized coal is supplied to the furnace to maintain load at the new load demand despite the inability of the pulverizer to instantaneously meet the new load demand due to pulverizer storage. Simultaneously with the output of pulverized coal from the pulverizer 20 stabilizing at that level necessary to maintain the new load demand, the diverting of pulverized coal away from the furnace is terminated.

As mentioned above, in the preferred embodiment of the present invention, the additional supply of pulverized coal to the furnace is established by feeding pulverized coal from a pulverized coal storage bin 42 into an air stream 46 through a variable speed feeder 44 at a rate sufficient to cause a step increase in the amount of pulverized coal supplied to the furnace from the first steady-state level to the second steady-state level. The stream of air and entrained pulverized coal is passed to the furnace 10 from the feeder 44 through lines 48 and injected into the furnace 10 at a location in the vicinity of the burners 12. The amount of pulverized coal supplied to the furnace through lines 48 is decreased by decreasing the rate of the feeder 44 so as to decrease the rate of feed of pulverized coal from the bin 42 into the air stream 46.

The speed of feeder 44 is controlled so that the amount of pulverized coal supplied to the furnace 10 in the air stream 46 is that amount necessary when added to the pulverized coal supplied to the furnace from the pulverizer 20 to hold the total supply of pulverized coal to the furnace at a constant level equal to the second steady-state level, i.e., that level necessary to maintain load on the furnace at the new demand level. A controller 50 receives a signal 52 from a sensing device disposed in the outlet of the pulverizer 20 which is indicative of the amount of pulverized coal being output from the pulverizer 20. The controller 50 also receives a signal 54 from a sensing device disposed in line 48 which is indicative of the amount of pulverized coal being supplied to the furnace from the independent source 42. The controller 50 then sums these two signals and compares that result, which is indicative of the total amount of pulverized coal being supplied to the furnace 10, to a set point indicative of the total amount of pulverized coal necessary to maintain load on the furnace at the new demand level. The controller 50 then generates a signal 56 which is sent to the pulverized coal feeder 44. In response to this signal, the speed of the pulverized coal feeder 44 will be changed in order to maintain the total amount of pulverized coal being supplied to the furnace at a constant level corresponding to the second steady-state level.

Thus, as the amount of pulverized coal supplied to the furnace from the pulverizer 20 increases in response to the step change in the rate of feed of raw coal to the pulverizer, controller 50 will decrease the speed of the pulverized coal feeder 44 so that the amount of coal being supplied to the furnace 10 from the independent source 42 is decreased such that the total amount of pulverized coal supplied to the furnace by means of the pulverizer 20 and the independent source 42 together remains constant at that level necessary to maintain load demand on the furnace 10 at the new level.

In the preferred embodiment of the present invention, the portion of pulverized coal diverted away from the furnace is diverted to the pulverized coal storage bin 42 at a rate sufficient to cause a step decrease in the amount of pulverized coal supplied to the furnace from the first steady-state level to the second steady-state level. The stream of air and entrained pulverized coal is diverted to the pulverized coal storage bin 42 through pipe 32 when control valve 34 is opened.

The opening of control valve 34 is controlled so that the amount of pulverized coal diverted to the storage bin 42 through pipe 32 is that amount necessary to maintain the supply of pulverized coal to the furnace at a constant level equal to the second steady-state level, i.e., that level necessary to maintain load on the furnace at the new demand level. A controller 60 receives a signal 52 from a sensing device disposed in the outlet of the pulverizer 20 which is indicative of the amount of pulverized coal being output from the pulverizer 20. The controller 60 also receives a signal 64 from a sensing device disposed in pipe 32 which is indicative of the amount of pulverized coal being diverted to the storage bin 42. The controller 60 then subtracts signal 64 from signal 52 and compares that result, which is indicative of the amount of pulverized coal being supplied to the furnace 10, to a set point indicative of the amount of pulverized coal necessary to maintain load on the furnace at the new demand level. The controller 60 then generates a signal 66 which is sent to the control valve 34. In response to this signal, the opening control valve 34 will be changed in order to maintain the amount of pulverized coal being supplied to the furnace at a constant level corresponding to the second steady-state level.

Thus, as the amount of pulverized coal supplied to the furnace from the pulverizer 20 decreases in response to the step change in the rate of feed of raw coal to the pulverizer, controller 60 will gradually close control valve 34 so that the amount of coal being supplied to the furnace 10 from the pulverizer 20 is maintained constant at that level necessary to maintain load demand on the furnace 10 at the new level.

Thus, in accordance with the present invention, there has been provided a novel method for rapidly changing the amount of pulverized coal supplied to a coal-fired furnace equipped with a pulverizer from a first steady state level to a second steady-state level in response to an increase in operating load demand. According to this method, the amount of pulverized coal supplied to the furnace can be instantaneously increased by supplying pulverized coal to the furnace from a source independent of the pulverizer thereby avoiding the delay inherent in the ability of the pulverizer to increase its output due to its storage capacity. Additionally, the amount of pulverized coal supplied to the furnace can be instantaneously decreased by diverting away from the furnace a portion of the pulverized coal being supplied by the pulverizer thereby avoiding the delay inherent in the ability of the pulverizer to decrease its output due to its storage capacity.

We claim:

1. A method of rapidly increasing the amount of pulverized coal supplied to a coal-fired furnace equipped with a coal pulverizer from a first steady-state level to a second steady-state level in response to an increase in the operating load demand of the furnace, comprising the steps of:

a. causing a step increase in the rate of input of raw coal to the pulverizer from a first rate corresponding to a pulverizer output commensurate with said first steady-state level to a second rate corresponding to a pulverizer output commensurate with said second steady-state level;

b. simultaneously with causing a step increase in the rate of input of raw coal to the pulverizer, establishing an additional supply of pulverized coal to the furnace from a source independent of the pulverizer, said additional supply of pulverized coal being initially established at an amount sufficient to cause a step increase in the amount of pulverized coal supplied to the furnace from said first steady-state level to said second steady-state level;

c. as the pulverizer output gradually increases in response to the step increase in rate of input of raw coal to the pulverizer, controllably decreasing the amount of pulverized coal supplied to the furnace in said additional supply so that the total amount of pulverized coal supplied to the furnace by means of the pulverizer and said additional supply together remains constant at said second steady-state level; and d. simultaneously with the pulverizer output stabilizing at said second steady-state level, terminating said additional supply of pulverized coal to the furnace from said independent source.

2. A method as recited in claim 1 wherein the step of establishing an additional supply of pulverized coal to the furnace from a source independent of the pulverizer comprises:

a. providing a bin of stored pulverized coal;

b. feeding pulverized coal from the bin into an air stream at a feed rate sufficient to cause a step increase in the amount of pulverized coal supplied to the furnace from said first steady-state level to said second steady-state level; and c. passing said air stream and the pulverized coal entrained therein to the furnace.

3. A method of rapidly decreasing the amount of pulverized coal supplied to a coal-fired furnace equipped with a coal pulverizer from a first steady-state level to a second steady-state level in response to a decrease in the operating load demand of the furnace, comprising the steps of:

a. causing a step decrease in the rate of input of raw coal to the pulverizer from a first rate corresponding to a pulverizer output commensurate with said first steady-state level to a second rate corresponding to a pulverizer output commensurate with said second steady-state level;

b. simultaneously with causing a step decrease in the rate of input of raw coal to the pulverizer, diverting a portion of the pulverized coal being supplied from the pulverizer away from the furnace, said diverted portion of pulverized coal being initially established at an amount sufficient to cause a step decrease in the amount of pulverized coal supplied to the furnace from said first steady-state level to said second steady-state level;

c. as the pulverizer output gradually decreases in response to the step decrease in rate of input of raw coal to the pulverizer, controllably decreasing the amount of pulverized coal diverted from the furnace so that the total amount of pulverized coal supplied to the furnace by means of the pulverizer and said additional supply together remains constant at said second steady-state level; and d. simultaneously with the pulverizer output stabilizing at said second steady-state level, terminating the diversion away from the furnace a portion of the pulverized coal being supplied from the pulverizer.

4. A method as recited in claim 3 wherein the step of diverting away from the furnace a portion of the pulverized coal being supplied to the furnace from the pulverizer comprises:

diverting a portion of the pulverized coal leaving the pulverizer to a storage bin at a rate sufficient to cause a step decrease in the amount of pulverized coal supplied to the furnace from said first steady-state level to said second steady-state level.

* * * * *